United States Patent [19]

Krämer

[11] Patent Number: 4,655,131

[45] Date of Patent: Apr. 7, 1987

[54] APPARATUS FOR CONVEYING AND PRINTING POSTAL ITEMS

[75] Inventor: Wilfried Krämer, Berlin, Fed. Rep. of Germany

[73] Assignee: Heinrich H. Klussendorf GmbH & Co. KG, Fed. Rep. of Germany

[21] Appl. No.: 799,199

[22] Filed: Nov. 18, 1985

Related U.S. Application Data

[63] Continuation of Ser. No. 653,308, Sep. 20, 1984, abandoned.

[30] Foreign Application Priority Data

Oct. 7, 1983 [DE] Fed. Rep. of Germany ..... 3336971

[51] Int. Cl.[4] ..... B41F 21/00; B41F 5/02

[52] U.S. Cl. ..... 101/236; 400/56; 400/625; 400/627; 271/2; 271/3.1; 271/121

[58] Field of Search ..... 101/2, 232, 233–243; 400/56, 624, 625, 627, 629; 271/2, 3.1, 8 A, 30 A, 121, 122

[56] References Cited

U.S. PATENT DOCUMENTS

| | | | |
|---|---|---|---|
| 2,988,984 | 6/1961 | Eckert, Jr. et al. | 101/236 X |
| 3,146,902 | 9/1964 | Voelker | 271/2 X |
| 3,537,393 | 11/1970 | Hegi | 101/235 |
| 4,269,405 | 5/1981 | Mitzel | 271/122 X |
| 4,275,875 | 6/1981 | Akers | 271/30 A X |
| 4,323,230 | 4/1982 | Rising | 271/30 A X |
| 4,346,876 | 8/1982 | Guenther et al. | 271/30 A X |
| 4,461,212 | 7/1984 | Geney | 400/56 X |

*Primary Examiner*—Clifford D. Crowder

*Attorney, Agent, or Firm*—Basile, Weintraub & Hanlon

[57] ABSTRACT

In an apparatus for stamping flat objects of different sizes and thicknesses, particularly postal items, said objects are arranged vertically on a feed table. The objects are individually removed from the latter and successively moved past a stamp and are then conveyed to a depositing table. The supplied and deposited objects are in parallel planes to one another. The feed and depositing tables are successively arranged in a vertical direction to one of these planes. The objects are removed from the feed table at right angles to said direction and are supplied to the depositing table. The objects are placed on the feed table by their leading edge in the transfer direction during individual removal. The conveying path of the object between the feed and depositing tables is horizontal.

5 Claims, 1 Drawing Figure

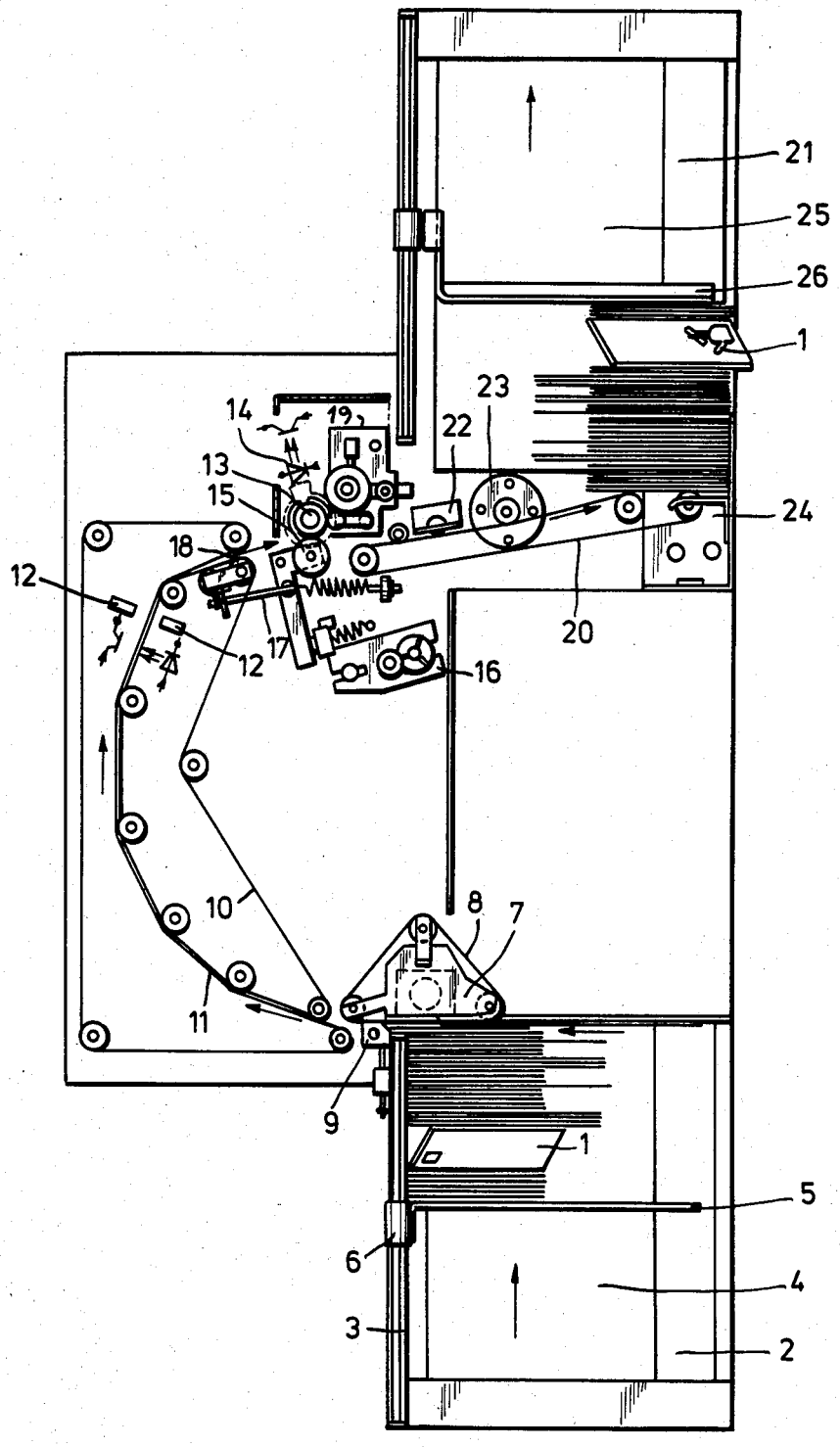
21
25
26
1
23
22
14
19
13
15
24
18
12
20
17
12
16
10
8
7
11
9
1
5
6
4
3
2

APPARATUS FOR CONVEYING AND PRINTING POSTAL ITEMS

This application is a continuation of application Ser. No. 653,308, filed 9/20/84, now abandoned.

BACKGROUND OF THE INVENTION

I. Field of the Invention

The present invention relates to an apparatus for stamping flat objects of different sizes and thicknesses, particularly postal items, which are arranged in a vertical or approximately vertical manner on a feed table, are singly removed therefrom, successively moved past a stamp and are conveyed to a depositing table. The fed and deposited objects are arranged in planes parallel to one another and the feed and depositing tables are successively arranged in a direction perpendicular to said planes. The objects are removed from the feed table at right angles to said direction and are supplied to the depositing table.

II. Description of the Prior Art

In such a known apparatus, the objects are stacked on the feed table in such a way that their rear edges, which are in the conveying direction during singling, engage against a common stop. During singling, the objects are then removed vertically upwards. As such apparatuses are normally used for stamping postal items, particularly letters, which can have widely varying sizes and weight, they suffer from the following disadvantages.

The singling device must be able to act over a considerable length compared with the objects to be singled, because the leading edges of the objects can vary widely between individual objects. Errors can also occur during singling, because the singling device can simultaneously take up and convey away several objects. Complicated measures are required for preventing this disadvantageous action. In addition, during singling considerable forces have to be applied, because the objects have to be raised. This force must be based on the maximum possible weight, although the weight of most objects is much lower.

SUMMARY OF THE INVENTION

The present invention provides an apparatus with which singling can be carried out more reliably and in which the singling device has a more simple construction than in the case of known devices. In particular, its size is reduced and the force acting on the objects to be singled is less.

In the present invention stamping flat objects of different sizes and thicknesses described hereinbefore is accomplished by the objects being placed on the feed table with their leading edges in alignment in the conveying direction during individual removal and the conveying path thereof between the feed table and the depositing table being horizontal.

BRIEF DESCRIPTION OF THE DRAWING

The invention is described in greater detail hereinafter relative to an embodiment shown in the drawing, which illustrates an apparatus for stamping flat objects, particularly postal items, of different sizes and thicknesses in plan view.

DESCRIPTION OF THE PREFERRED EMBODIMENT

Referring to the drawing, there is illustrated an example of the present invention in the form of a feed table 2 on which the objects 1 to be stamped are stacked. The objects 1 are vertically arranged and one edge engages with a registering or locating stop 3. The objects 1 are located on a feed conveyor belt 4 and are kept in their vertical position by a feed stacking plate 5. Stacking plate 5 is fixed to an articulation 6, which is displaceable on the locating stop 3. The feed stacking plate 5 rests under its own weight on conveyor belt 4 and is always pressed by the latter against the objects 1 located on feed table 2. Conveyor belt 4 is movable in the direction indicated by the arrow. The movement of conveyor belt 4 is controlled by a switch (not shown) which is located in the vicinity of a pneumatic separating device 7 and determines the contact of the objects 1 with the separating device 7.

Separating device 7 has a revolving perforated belt 8 which exerts a vacuum on the furthest forward object of the stacked objects 1. Perforated belt 8 revolves clockwise and thereby moves with it the sucked-on, furthest forward object 1. A pneumatic backstop 9 facing perforated belt 8 contains the second object arranged behind the first object in the case where it happens to be carried along by the first object as a result of friction. Back-stop 9 also operates under vacuum, but this is lower than the vacuum acting through perforated belts 8 on the first object.

The objects 1 singled in the aforementioned manner are passed into the gap between two revolving conveyor belts 10 and 11 and are moved between them in the direction of the arrow.

The speed of conveyor belts 10 and 11 is higher than that of the perforated belt 8. As a result, the objects 1 guided between conveyor belts 10 and 11 are moved away more rapidly than the following objects supplied by the perforated belt. This leads to a gap being formed between the individual objects, which is adequate in order to be able to detect them individually.

The singled objects conveyed between conveyor belts 10 and 11 are detected by a light barrier 12. On detecting the leading edge of an object, this releases a revolution of a stamp 13 following in the conveying path of the objects. The stamp is replaceably fixed to a core-toothed stamp shaft. A further light barrier 14 is used for positioning the stamp 13 in the basic position between two stamping processes.

The object 1 released by conveyor belts 10 and 11 is supplied to the gap between stamp 13 and a back pressure roller 15. The resiliently mounted, driven back pressure roller 15 ensures strong, uniform stamp impressions. It is possible to preset the gap between stamps 13 and back pressure roller 15 by means of an adjusting device 16. This is advantageous when stamping approximately equally thick objects 1. This makes it possible to prevent continuous, percussive movements of the back pressure roller 15.

Back pressure roller 15 is also connected via an articulation 17 with a movably mounted pulley 18 which is used for guiding conveyor belt 10 and is arranged at the outlet of the slot formed by conveyor belts 10 and 11. As a result of this articulated connection between pulley 18 and back pressure roller 15, the latter is preset to the thickness of an object before the latter reaches stamp 13. Thus, uniform stamp impressions are still obtained, even in the case of varyingly thick objects.

An inking mechanism 19 with a filtered cylinder impregnated with the stamp ink and a driven intermediate roller is used for the uniform inking of stamp 13 during each revolution thereof.

After passing stamp 13, the objects 1 are taken up by a further conveyor belt 20 and are fed to a depositing table 21. This transfer additionally takes place with the aid of a guide plate 22 with a guide roller and supporting roller 23 with driving plate.

Depositing table 21 has substantially the same construction as feed table 2. The entering objects are initially separated from conveyor belt 20 by a stop bracket with stripper 24. The stacked objects are conveyed in the direction of the arrow by a depositing conveyor belt 25. A depositing stacking plate 26 displaceable in the same way as stacking plate 5 is pressed by a counterweight against the stacked objects 1, so that said objects are kept in their vertical position. They can be manually removed from the depositing table, whereby stacking plate 26 is then automatically moved toward the stripper 24 until it meets the newly deposited objects.

Through the leading edges of the objects 1 engaging with the locating stop 3, it is ensured that in each case only the furthest forward object comes into contact with the perforated belt 8 of the pneumatic separating device 7, so that reliable singling is made possible. Due to the fact that the objects are only moved horizontally from separating device 7 to conveyor belts 10 and 11, the suction force acting on the objects can be kept relatively small.

I claim:

1. An apparatus for stamping flat objects of different sizes and thicknesses, particularly postal items, comprising:

a feed table on which said objects are arranged in a vertical or approximately vertical manner;

a separating device located on the feed table, the separating device comprising:

(a) a perforated revolving belt oriented parallel to the leading flat object, the perforated revolving belt moving at a first speed and having means for creating a first vacuum force through the perforations such that the revolving belt lifts the leading object from the feed table by means of the first vacuum force; and (b) a pneumatic backstop adjacent to the feed table and parallel to the perforated revolving belt, the pneumatic backstop having a means for creating a second vacuum force less than the first vacuum force, the pneumatic backstop capable of separating a second object from the leading object and holding the second object at the feed table;

means for conveying the objects away from the separating device, the conveying means comprising two oppositely revolving conveyor belts oriented parallel to one another for a portion of each revolution forming an inlet located adjacent to the separating device and an outlet, the conveyor belts moving at a second speed greater than the first speed at which the perforated revolving belt moves;

a revolving stamp located adjacent to the outlet of the two revolving belts, the revolving stamp movable between an actuated position and a basic position;

means for detecting the object as it approaches the stamp, the detecting means triggering movement of the stamp;

means for conveying the object away from the stamp; and a depositing table to which said objects are fed as they are conveyed away from the stamp, the fed and deposited objects being arranged in planes parallel to one another and the feed and depositing tables are successively arranged in a direction perpendicular to said planes, the objects being removed from the feed table at right angles to said direction and are supplied to the depositing table, where the objects are placed on the feed table with their leading edges in alignment in the conveying direction during individual removal and the conveying path thereof between the feed table and the depositing table is horizontal.

2. The apparatus of claim 1 wherein the conveying means comprises a first revolving conveyor and a second revolving conveyor belt, the first revolving conveyor belt having a plurality of associated guide rollers around which the conveyor belt travels, the guide rollers defining a convex path through which the conveyor belt travels when parallel to the second belt, at least one roller located at the end of the convex path being pivotally movable away from the second belt; and the second revolving belt having at least four guide rollers which define an essentially rectangular path of rotation, one leg of said path being deflected into a concave path of travel by the convex path of the first conveyor belt.

3. The apparatus of claim 2 wherein the detecting means comprises:

a movably mounted back pressure roller facing the revolving stamp and connected to the movable guide roller of the first conveyor belt, said back pressure roller moving with the thickness of the object to be stamped; and means for moving the back pressure roller, the moving means comprising:

(a) a lever arm connected to the back pressure roller;

(b) means for biasingly positioning the back pressure roller adjacent to the stamp; and (c) an articulating arm attached to the lever arm and to the movable guide roller of the first conveyor belt such that movement of the movable guide roller urges the lever arm against a biasing force exerting by the biasing means.

4. The apparatus according to claim 1 wherein the feed table and the depositing table each comprise a horizontally arranged conveyor belt, whose movement is controllable as a function of the removal or supply of the objects.

5. An apparatus for stamping flat objects of different sizes and thicknesses, particularly postal items comprising:

a feed table on which the objects are arranged in a vertical or approximately vertical manner;

a separating device located on the feed table, the separating device comprising:

(a) a perforated revolving belt positioned above the leading object moving at a first speed having means for creating a first vacuum force through the perforations, the perforated revolving belt removing the leading object from the feed table by means of the first vacuum force; and (b) a pneumatic back stop facing the perforated belt having means for creating a second vacuum force, the pneumatic back stop removing a second object when it is carried along with the leading object, wherein the second vacuum force is less than the first vacuum force;

a first revolving conveyor belt having a plurality of associated guide rollers around which the first conveyor belt travels, the associated guide rollers defining a convex area through which the first belt travels, at least one of the associated guide rollers located at the end of the convex path being pivotally movable;

a second revolving conveyor belt having at least three associated guide rollers which define a path of rotation, one leg of the path being deflected into a concave path of travel by the convex portion of the first conveyor belt, the first revolving conveyor belt and the second revolving conveyor belt cooperating to form an inlet adjacent to the separating device and an outlet;

a revolving stamp located adjacent to the outlet of the two revolving belts, the revolving stamp movable between an actuated position and a basic position;

means for detecting the object as it approaches the stamp, the detecting means triggering the movement of the stamp, the detecting means comprising:

a movably mounted back pressure roller facing the revolving stamp and connected to the movable roller of the first conveyor belt, the back pressure roller movable in response to the thickness of the object to be stamped;

means for moving the back pressure roller, the moving means comprising:

(a) a lever arm connected to the back pressure roller;

(b) means for biasingly positioning the back pressure roller to a position adjacent to the stamp; and (c) an articulating arm attached to the lever arm and to the movable guide roller of the first conveyor belt such that the movement of the movable guide roller urges the lever arm against the biasing force exerted by the biasing means;

means for conveying the object away from the stamp; and a depositing table to which said objects are fed as they are conveyed away from the stamp, the fed and deposited objects being arranged in planes parallel to one another and the feed and depositing tables are successively arranged in a direction perpendicular to said planes, the objects being removed from the feed table at right angles to said direction and are supplied to the depositing table, wherein the objects are placed on the feed table with their leading edges in alignment in the covering direction during individual removal and the conveying path thereof between the feed table and the depositing table is horizontal.

* * * * *